US005117753A

United States Patent [19]

Mamberer

[11] Patent Number: 5,117,753

[45] Date of Patent: Jun. 2, 1992

[54] MULTI-STATION PRINTING MACHINE SYSTEM

[75] Inventor: Hans Mamberer, Königsbrunn, Fed. Rep. of Germany

[73] Assignee: Man Roland Druckmaschinen, Fed. Rep. of Germany

[21] Appl. No.: 672,476

[22] Filed: Mar. 20, 1991

[30] Foreign Application Priority Data

Apr. 19, 1990 [DE] Fed. Rep. of Germany ..... 4012396

[51] Int. Cl.[5] ..... B41F 13/56

[52] U.S. Cl. ..... 101/225; 101/228; 101/231; 101/181; 101/176

[58] Field of Search ..... 101/225, 228, 231, 180, 101/181, 176, 178, 424.1, 179, 182; 226/108, 109, 110; 270/4, 5, 20.1

[56] References Cited

U.S. PATENT DOCUMENTS

| | | | |
|---|---|---|---|
| 971,533 | 10/1910 | Firm | 270/4 X |
| 1,307,390 | 6/1919 | Wood | 101/225 |
| 1,738,324 | 12/1929 | Scott | 101/222 |
| 1,774,119 | 8/1930 | Waller | 101/424.1 X |
| 1,774,779 | 10/1930 | Wood | 270/5 |
| 1,847,708 | 3/1932 | Barber | 101/178 |
| 1,971,771 | 8/1934 | Crafts | 101/225 |
| 2,911,908 | 11/1959 | Johnson | 101/181 |
| 3,068,787 | 12/1962 | Dall'oglio | 101/181 |
| 3,084,621 | 4/1963 | Guastavino | 101/181 |
| 3,605,618 | 9/1971 | Clasen | 101/181 X |
| 3,717,092 | 2/1973 | Crum | 101/248 |
| 3,841,216 | 10/1974 | Huffman | 101/181 |
| 4,096,801 | 6/1978 | Martin | 101/227 |
| 4,177,730 | 12/1979 | Schribner | 101/248 |
| 4,437,402 | 3/1984 | Fischer | 101/181 |

FOREIGN PATENT DOCUMENTS

| | | | |
|---|---|---|---|
| 623588 | 7/1961 | Canada | 270/5 |
| 267007 | 5/1988 | European Pat. Off. | 101/181 |
| 2122416 | 11/1972 | Fed. Rep. of Germany | 101/228 |
| 2460612 | 6/1976 | Fed. Rep. of Germany | 101/424.1 |
| 2753433 | 5/1979 | Fed. Rep. of Germany | 101/181 |
| 201020 | 1/1939 | Switzerland . | |
| 5728 | 4/1913 | United Kingdom | 270/5 |
| 702603 | 1/1954 | United Kingdom | 270/5 |
| 1119142 | 7/1968 | United Kingdom | 101/180 |
| 2189745 | 11/1987 | United Kingdom | 101/181 |

OTHER PUBLICATIONS

De-Buch: Alexander Braun, Atlas des Zeitungs-und Illustrationsdruckes, Polygraph-Verlag GmbH Frankfurt am Main, 1960, S.189-(Book by Alexander Braun, "Atlas of Newspaper and Magazine Printing").

De Prospekt: Albert In-Line-Finishing Systems, BV 01842 (Publicity Material: Albert In-Line-Finishing Systems).

De-Z: Deutscher Drucker Nr. 30/24.9.87 w 140 bix w 142, w 154 bis 157 ("German Printer: No. 30/24 Sep. 1987").

*Primary Examiner*—Edgar S. Burr

*Assistant Examiner*—Eric P. Raciti

[57] ABSTRACT

To permit versatile operation of a multi-station printing machine installation or system having a first printing machine subsystem for printing on a first substrate web which includes a plurality of printing stations (2-5) and accessory apparatus, such as dryers, coolers, folders and the like, and a second printing machine subsystem (11) likewise having a plurality of printing stations (12-15), dryers, coolers and folders, and wherein the first subsystem, additionally, includes auxiliary apparatus such as a lacquering unit (6), an adhesive application unit (21), and further paper handling units (22, 23, 24) which may be useful for certain printing jobs carried out by the further printing machine subsystem (11) but are not always used for printing jobs in the first subsystem (1), substrate web guide means (47-50, 53, 54) are provided in each one of the subsystems to guide the web from, for example, the further subsystem (11) to the auxiliary apparatus (6; 21-24) of the first subsystem and then, if desired, back to the remaining units of the second subsystem. The arrangement permits selective use of auxiliary apparatus units which are not always needed, and thus which are required, in the overall installation, only once. A synchronizing and control unit (10, 10') receives, in servo loops, input command signals from an input/output unit (55) and provides motor control signals, individually, to the drive motors (41, 43, 44) of the respective subsystems as well as to drive motors (42, 69) of the auxiliary apparatus, so that the auxiliary apparatus will operate in synchronism with the motors of the respective subsystem primarily handling printing on the respective substrate web (45, 46).

20 Claims, 7 Drawing Sheets

MULTI-STATION PRINTING MACHINE SYSTEM

FIELD OF THE INVENTION

The present invention relates to printing machinery, and more particularly to a multi-station printing machine system in which the printing machine system is divided into two or more subsystems which can, each, be operated independently, and in which one of the subsystems includes auxiliary apparatus, such as paper handling, controlling or other units, which can be selectively connected to handle substrates, typically paper, from either one of the printing machine subsystems.

BACKGROUND

The variety of printing jobs which have to be carried out on printing machine systems frequently requires accessory or auxiliary apparatus such as dryers, folders, cutters, calendaring machines, adhesive applicators, stapling machines and the like. Not all such accessory or auxiliary apparatus or machines are needed at all times. A printer cannot predict the recurrence of similar printing jobs. Consequently, the accessory or auxiliary apparatus units are rarely in continuous operation. Yet, they must be present to afford the printing machine system operator the opportunity to handle printing jobs which require additional, accessory or auxiliary apparatus. Idle machinery represents an uneconomical investment. The desire to be able to provide the best possible and comprehensive printing service to a customer is opposed by the economics of printing machine system operation.

THE INVENTION

It is an object to improve printing machine systems, and particularly printing machine subsystems, which have a plurality of associated or auxiliary apparatus coupled thereto, so that various types of jobs can be carried out without substantially increasing the costs of the auxiliary or accessory apparatus.

Briefly, the printing machine installation or system has a plurality of printing machine subsystems, each of which can carry out, independently, a complete printing job. One of the individual subsystems has auxiliary apparatus which may not be effectively continuously needed in connection with the respective printing machine subsystem. Web guide arrangements are provided to guide the web from any one of the subsystems to that one which has the auxiliary apparatus. The auxiliary apparatus is driven by an individual controllable drive motor, which is controlled from a synchronizing control unit which synchronizes the drive of the motor for the auxiliary apparatus with the drive of the printing machine subsystem, the web of which is being handled in the auxiliary apparatus.

The arrangement has the advantage that the printing machine system operator can use available auxiliary apparatus not only with the particular printing machine subsystem with which it may be physically associated, for example by being mounted in association therewith, so that a printing web from the respective subsystem can pass straight therethrough, while also permitting use of the auxiliary apparatus by a printing web from another printing machine subsystem when the first or associated subsystem does not need to use the particular auxiliary apparatus or unit.

DRAWINGS

DETAILED DESCRIPTION

Figure 1:
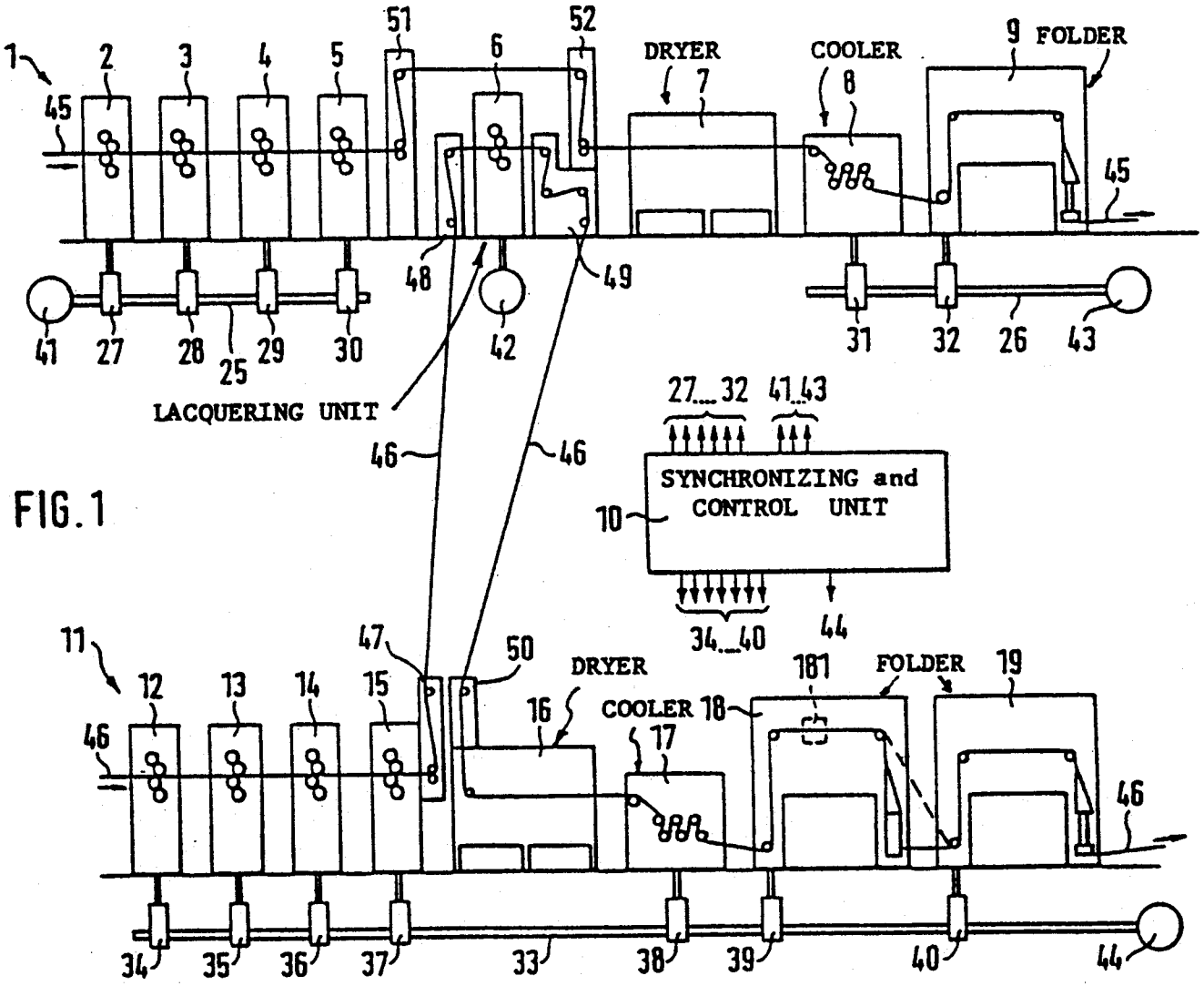
FIG. 1 is a highly schematic representation of a first embodiment of a printing machine system in accordance with the present invention.

Referring first to FIG. 1:

The printing machine system has two completely independent and independently driven rotary printing machine subsystems 1, 11. These subsystems 1, 11 may be located above each other, or next to each other.

The first subsystem 1 has printing stations 2, 3, 4, 5; the particular configuration of the printing stations does not form part of the present invention, and any type of printing station may be used; the schematic diagram merely illustrates rotary offset printing stations, in which even the inkers and dampers have been left off. In addition to the printing stations 2—5, the first subsystem 1 has a lacquering unit 6, a dryer 7, cooler or temperature dropping unit 8, and a folder 9. The subsystem 1 is driven by a first drive motor 41. The lacquering unit 6, which forms an auxiliary apparatus for the printing machine system has its own, second drive motor 42. The accessory apparatus formed by the dryer 7, cooler 8 and folder 9, to the extent that they need be driven, are separately driven by a third drive motor 43. First motor 41 drives shaft 25, which extends along the printing stations 2–5, and is coupled by respective clutches and/or gear arrangements 27–30 to the individual printing stations 2–5 respectively. Third motor 43 drives a shaft 26 which, in turn, is coupled by clutches and/or gears 31, 32 to the cooler 8 and the folder 9. Typically, the shafts 25, 26 extend longitudinally along the individual stations or units of the subsystem 1. The stations or units 2–5, 8, 9 can be individually coupled to the respective drive shaft 25, 26. A substrate web 45, typically a paper web, is guided through the printing machine as schematically shown in FIG. 1.

The second printing machine subsystem 11 has a single, fourth drive motor 44, which drives a shaft 33 extending longitudinally along the subsystem 11. The subsystem 11 has four printing stations 12, 13, 14, 15, a dryer 16, a cooler 17 and two folding units or folders 18, 19. Motor 44 drives a shaft 33, and the respective printing stations 12–15 and the accessory apparatus 16, 17, 18, 19 can be selectively coupled to the shaft 33 by clutch and/or gear units 34–40. Thus, the accessory units as well as the printing stations can be individually coupled to the shaft 33, independently of each other. A substrate web 46, for example of paper, is passed through the respective printing stations and accessory apparatus units.

The substrate web 45 as well as the substrate web 46 are supplied by a suitable supply roller, for example a web changing apparatus, as well known. At the output end of the printing station 5, paper web 45 is guided over guide elements, such as guide rollers 51, 52 around the lacquering unit 6 and directly into the dryer 7. Thereafter, the paper web 45 passes through the driven cooler 8 and the folder 9.

The paper web 46, supplied also for example from a roll changer, not shown, is passed through the printing stations 12–15.

In accordance with a feature of the invention, and if a printing job so requires, the web 46 is then guided through the auxiliary apparatus formed by the lacquering unit 6 in the subsystem 1. Guide rollers 47, 50 guide the web 46 in the subsystem 11; guide roller 47 guides the web 46 to a guide roller system 48, to pass the web 46 through the lacquering unit 6; a guide roller system 49 then returns the web 46 to a guide roller system 50 for passing the web 46 through the dryer of the subsystem 11. The guide roller systems 47–50 may include a plurality of guide rollers, in accordance with the relative spatial position of the subsystems 1, 11; and, if required, web deflection bars and the like to provide for the web path between the subsystems 1 and 11, as shown only schematically in FIG. 1.

Upon return of the paper web 46 to the subsystem 11, the web 46 is guided into the dryer 16, then through the cooler 17 and the folders 18, 19. The web can be guided in the folders 18, 19 as shown in the solid-line position, to obtain folding twice of the same web 46; alternatively, the web 46 can be cut or slit in a slitter 181 into two or more web sections, from which at least one web section is guided in the path shown by the solid line for double folding and the remaining web section or sections are guided in the path shown by the broken line, to be folded only once.

In accordance with a feature of the present invention, the auxiliary unit 6, namely the lacquering unit, can be selectively used on products which cannot be printed on the subsystem 1 because double folding in two folders 18 and 19 is required. The double folders 18, 19 may also be considered as auxiliary or accessory apparatus. If the guide roller arrangements 47, 50 to guide the web 46 from subsystem 11 to the subsystem 1 would be missing, a printing job which requires lacquering and double folding could not be carried out, or the additional investment of a further lacquering unit for the subsystem 11 would be necessary, which may be used only occasionally—and which then would represent an uneconomically installed subsystem.

The individual subsystems of the overall printing machine system are controlled by a synchronizing and control unit 10.

The synchronizing and control unit 10 is provided to respectively couple together or separate the individual units or stations of the subsystems 1 and 11, and, if so designed, further printing machines or printing machine subsystems, and to further control the operation and respective engagement of the motors driving the respective drive shafts 25, 26, 33. Thus, independent of the physical position of the respective printing stations, subsystems, or units, and specifically independent of the location and relative location of any specific printing machine subsystem, one or more of the units or printing stations of any one of the subsystems can be engaged or, selectively, disengaged. Further, of course, the speed of the respective drive motors can be changed and controlled for synchronized operation by the synchronizing and control unit.

The synchronizing and control unit 10 includes a plurality of motor controllers and microprocessors which, in turn, control the operation of the motor controllers; it further includes respective control units which selectively operate the clutch and/or gear units 27–30, 31, 32 and 34–40 in order to operationally cause synchronized operation of the printing machine units, stations, and subsystems in selectively desired configuration.

Control circuits for speed control of motors are well known; controlling such control circuits, in turn, in accordance with a predetermined program, for example entered by a suitable input/output unit coupled to and possibly forming part of the synchronizing and control unit, likewise, are well known, and any suitable system may be used. The arrows emanating from the synchronizing and control unit block 10 symbolically indicate the control connections.

Figure 2:
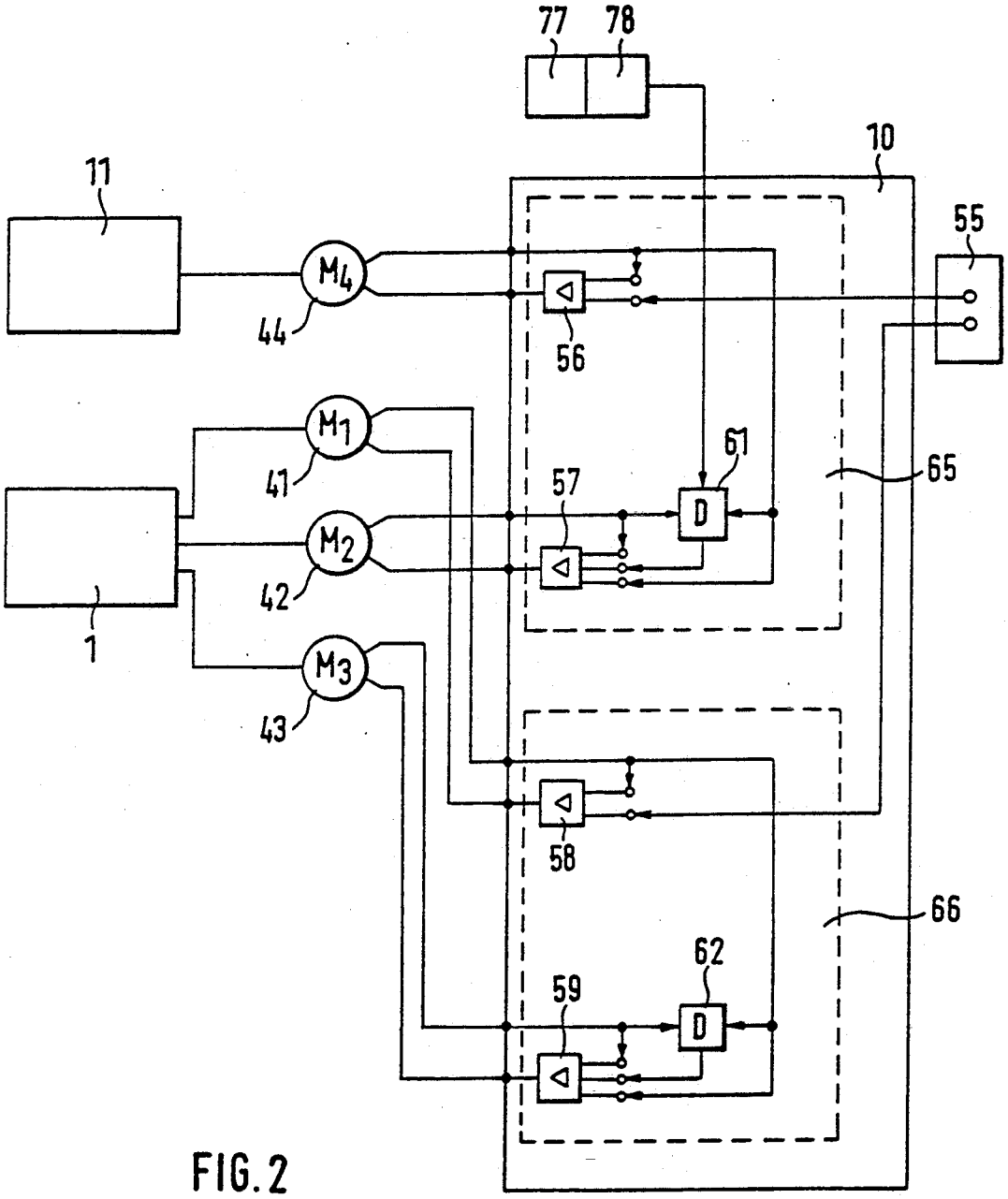
FIG. 2 is a block diagram of a synchronizing and control arrangement for the printing machine system of FIG. 1.

FIG. 2 is a fragmentary, highly schematic block diagram of a portion of the synchronizing and control unit 10 for the system shown in FIG. 1. The synchronizing and control unit 10 has a first control circuit 65 and a second control circuit 66. The control functions of the circuits, effectively, control the speed of the drive motors 41–44, and control the connection of the respective units, stations, apparatus or elements to the respective drive shafts. The printing machine subsystem 11 is driven entirely by motor 44. In the printing machine subsystem 1, however, units 2–5, forming the printing stations, are driven by motor 41; the lacquering unit 6 is driven independently by a motor 42; and motor 43 drives the cooler 8 and folder 9 of subsystem 1. Motors 42 and 44 are coupled to the control circuit 65. Motors 41 and 43 are coupled to the control circuit 66. The two control circuits 65, 66, respectively, control the speed of operation of the motors 42, 44, and 41, 43, respectively. It is noted that the respective control unit 65, 66, thus, are associated with the motor drives for the respective units which process or handle the webs 45 and 46. Thus, the control unit 65 ensures that all motors which drive units or stations through which the web 46 passes operate properly and in synchronism.

An input/output unit 55, for example a keyboard, control panel or the like, or a data reading unit, provides a first external command value for the speed of the motor 44. This command value is applied to the input of a controller 56. A second input of the controller 56 receives a signal representative of the actual speed of the motor 44, in form of a feedback signal. The controller 56 forms a difference between the actual value and the command value to derive a control signal and changes the speed of the motor 44, as well known, to null a difference or deviation signal. A controller 57 is provided to control the speed of the motor 42. The controller 57 receives as input value the actual speed of motors 42 and 44 as well as an additional control input derived from a sensing signal sensing passage of the web 46, as will be described below. Controller 57 provides an output signal which controls the speed of the motor 42 in well known manner, that is, to match the speed of the motor 42 to that of the motor 44, so that the web 46 will be pulled through the entire subsystem 11 and the lacquering unit 6 of subsystem 1 at a uniform speed.

The control circuit 66 has a controller 58 therein which controls the speed of the motor 41. The motor 41 receives as an input value a command signal from the input/output (I/O) unit 55, forms a difference between the command value and an actual speed value and provides an output signal to null the difference and thereby control the speed of the motor 41 to assume the value commanded by the command signal. A controller 59, in a similar manner, controls the speed of the motor 43. It receives the command signal for the speed, a feedback actual speed signal, and a further input signal to be described below.

Each of the four motors 41–44 is subject to reactions tending to change its instantaneous speed due to the drive of the respective elements, apparatus units and the like forming part of the respective subsystems. In order to be able to compensate for these reactions, the actual and instantaneous speed values of the four motors 41–44 are connected to input circuits of respective microprocessors 61, 62. Microprocessor 61 has contained therein an appropriate algorithm which, and considering the respective input values, provides an additional control unit for the controller 57, in order to compensate for variations which are not sufficiently controlled by the mere feedback actual speed signal applied to the controller 57. Similarly, microprocessor 62 calculates an additional control signal for the controller 59. Such additional or higher order control levels are well known and any suitable algorithm, matched to the power input/torque-speed performance of the motor in the specific unit which is driven by the motor can be used. In this connection, it should be noted that selectively disconnecting clutches or couplings, for example within the clutch trains 34, 35, 36, 37, may well change this performance; since such performance characteristics are known, a suitable memory, for example a read-only memory (ROM) can be included in the respective controller 61, 62 so that the additional control signal which is applied to the respective controllers 57, 59 will be appropriately provided in accordance with the respectively engaged or disengaged clutches or couplings.

The control circuits 65, 66 are connected in accordance with the well known master-slave system. One of the drives to be controlled, for example motor 44 in the circuit 65 and motor 41 in the circuit 66, is considered the master drive. Thus, that particular motor receives the command input signal from the I/O unit 55. The other motor, in the example motors 42 and 43, then will be the slave motors, the speed of which is controlled in dependence on the actual speed of the master motor. The two control circuits 65, 66 thus control the motors 42 and 44 as well as 41 and 43 of the subsystems 111 with respect to their speed in such a manner that the unit 6 of the subsystem 1 is synchronized with the units 12–19 of the subsystem 11. The cooler unit 8 is synchronized with the printing station 5 of subsystem 1 when the subsystem 1 is used in a printing operation which does not utilize the lacquering unit 6.

The control of the speed of the motor 42 can be improved by providing a register mark scanner 77, such as a suitable sensor, attached or secured to the lacquering unit 6. The scanner or sensor 77 is coupled to a signal processing, calculating and control unit 78 which generates an electrical signal corresponding to the position of register marks applied to the paper web 46. This signal is connected to the microprocessor 61 as an additional control signal for, additionally, controlling the speed of the motor 42. This additional control of the motor speed 42 is particularly desirable if the lacquering unit 6 is spaced from the printing machine subsystem 11 by a substantial distance, so that the web path between the guide rollers 47, 48 and 49, 50 is comparatively long. It is, of course, also possible to obtain a similar improvement of motor speed control if the web is passed through any other accessory or auxiliary unit in the subsystem 1 from the subsystem 11, and by providing a register mark sensor with the respective auxiliary or accessory unit. This additional improvement can be obtained by similar application of signals from suitable sensors, connected to a suitably arranged signal processing, possibly modification and control element.

The circuit diagram, shown schematically in FIG. 2, illustrates only one example of the controllers and microprocessors suitable for use in a synchronization apparatus 10. Other types of synchronization units may be used, as well known in the motor control field. A suitable number of elements or units or circuits, for example of the type of the controller 56 or 57, or of the microprocessor 61, can be used, and interconnected in a similar or different manner, as known in the art, so that both printing machine subsystems and all the respective accessory or auxiliary apparatus elements and units will operate for handling, respectively, webs 45 and 46 in synchronous operation as the webs pass through the respective stations, units or apparatus elements. Other combination units may be used, for example to handle the webs 45 as received from the folder 9, or the webs 46 as received from the folder 19, separately or conjointly. In dependence on the required further paper handling or paper processing, motors 42 and 43 then must be synchronized with the motor 41, or motors 42, 43, 44 must be synchronized with the motor 41. The respective number of the accessory or auxiliary units and the respective printing stations 2–5 and 12–15 will determine the way the synchronizing and control unit is connected to the respective motors, and the respective units or elements will depend on how many printing machines, printing machine stations and subsystems are available for the entire printing plant, and how many motors, overall, must be controlled.

Figure 3:
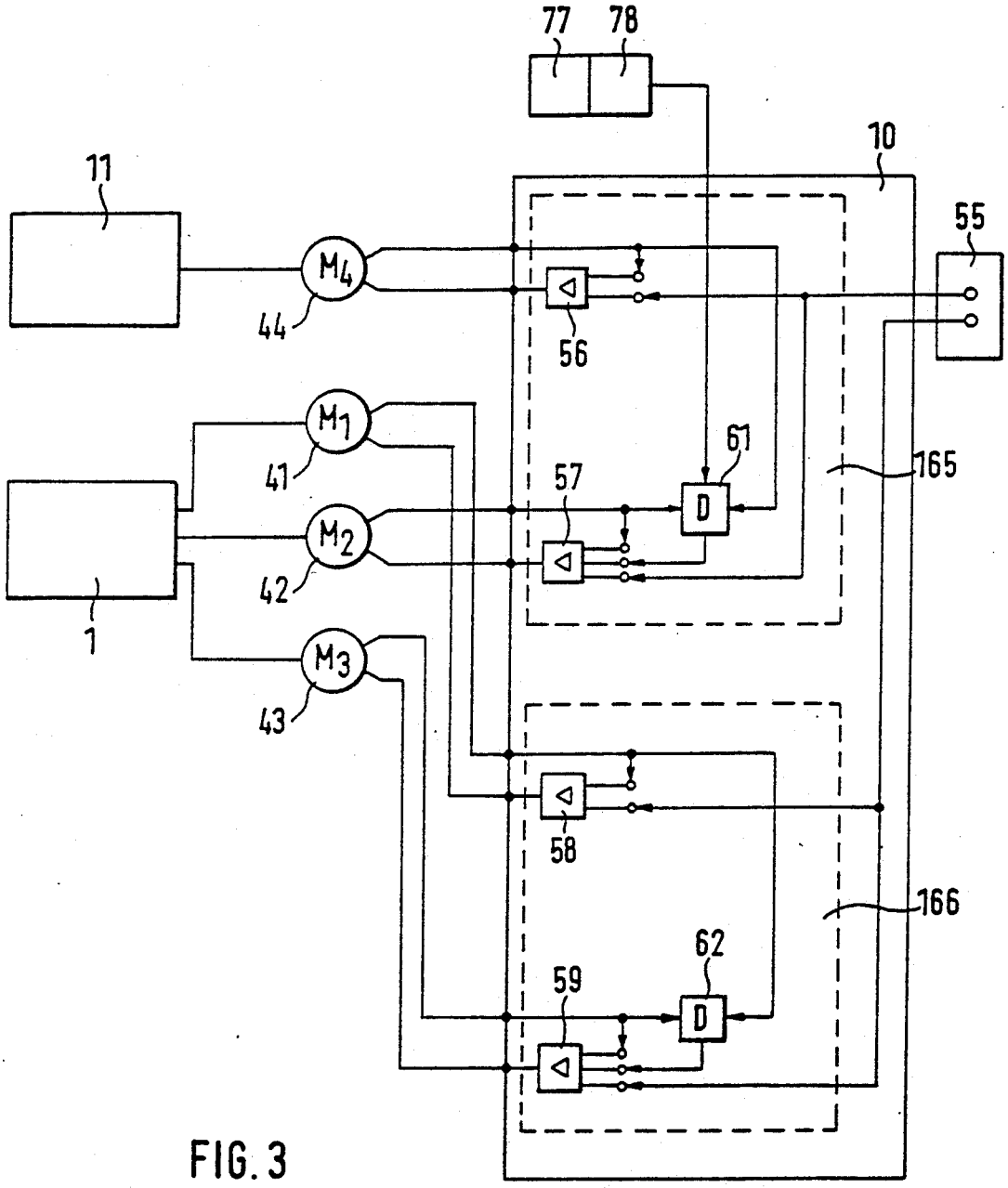
FIG. 3 is another embodiment of a control system in block diagram form.

FIG. 3 illustrates a block circuit diagram to synchronize the subsystems 1, 11 of FIG. 1, in a modified form. The circuit of FIG. 3 differs from that of FIG. 2 in that both of the controllers 56, 57 and 58, 59 of the control circuits 165, 166 will receive the command value commanding their speed from the I/O unit 55. Otherwise, the circuits 165, 166 are similar to the circuits 65, 66 of FIG. 2. The circuits 165, 166, in essence, are independent servo control circuits which have an advantage over that of FIG. 2, in that the speeds of the motors 42, 44 and 41, 43, respectively, are controlled on the basis of the same speed command value, so that the speed of the motors 42, 43 is not dependent on the actual speed of the motors 44, 41, which are continuously under the control command of the command signal from the I/O unit 55. In other words, the command signal is directly applied to the controllers 57, 59, rather than the already controlled feedback signal as in FIG. 2. Since the motors and the associated equipment all have inertia and speed control by the respective controllers 56, 57 and 58, 59 is not instantaneously reflected in actual speed, the circuit of FIG. 3 has the advantage of overall faster response.

Figure 4:
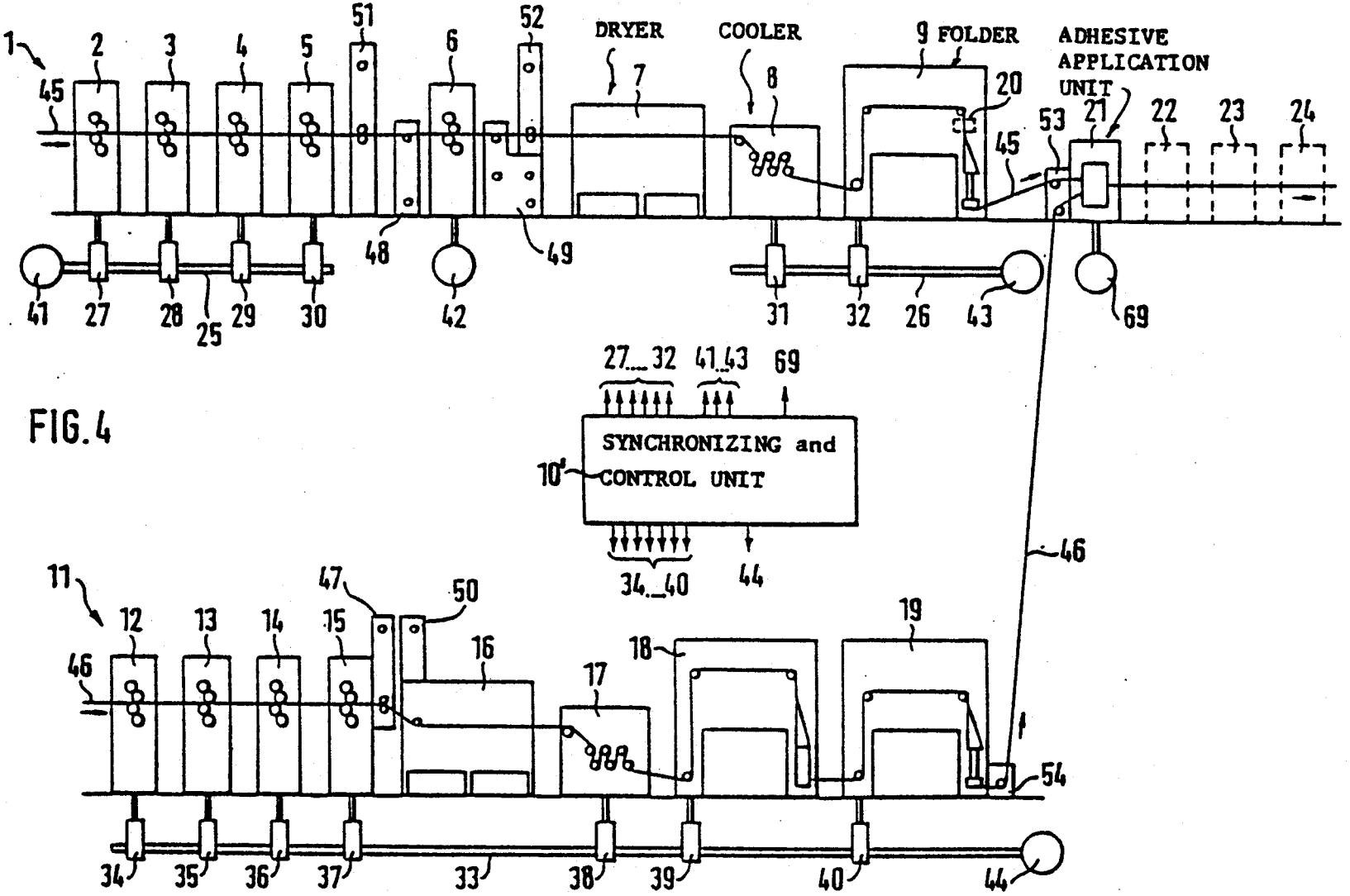
FIG. 4 is a schematic view of another embodiment of a printing machine system in accordance with the present invention.

Embodiment of FIG. 4

The subsystems 1, 11 of the printing machine installation shown in FIG. 4 are similar to those already described in connection with FIG. 1, and the same reference numerals have been used for identical apparatus. The difference between the installations of FIGS. 4 and 1 is the addition of further auxiliary elements 21–24. The auxiliary unit 21, connected downstream—with respect to the running operation of the web 45 or 46, respectively—an adhesion or adhesive application unit 21, and further units, may be associated with the printing system or installation, as shown in broken lines by units 22, 23, 24. For example, unit 22 can be a cross-positioning unit, the unit 23 an intermediate transport unit to transport semi-finished or completed combined printing products to a further processing station, for further processing or handling, shown schematically at station or unit 24, such as a packaging or wrapping station. Of course, different units or stations which may be used only temporarily or not continuously with any one particular subsystem can be connected to one or the other of the subsystems 1 or 11. Typically, the folder 9 will, then, also have a perforating device 20 associated therewith. Since such perforating devices can be integrated into the folder and usually do not require a separate drive, they can remain in the folder and be used only as necessary. No extensive capital investment is necessary for a perforating apparatus.

The subsystem 1 receives the paper web 45, as before, and runs, as shown, entirely and unimpededly through the subsystem 1 having printing stations 2–5, through the lacquering unit 6, dryer 7, cooler 8, folder 9, and perforating unit 20. The particular path of the paper web 45 can be suitably selected as desired and required by the particular printing job.

The subsystem 11 receives the paper web 46, for example from a web roll changer which completely passes through the subsystem 11, that is, through printing stations 12–15, dryer 16, cooler 17, and folders 18 and 19. Downstream of the folder 19, the folded web is guided over a guide roller system 54, part of the subsystem 11, to the guide system 53 at the input to the adhesive application unit 21 and passes through the adhesive application unit 21 together with the web 45. The paper webs are joined in the adhesive application unit 21 and are then further processed in the auxiliary units shown only in broken line. Alternatively, for example, the units 22, 23, 24 . . . 2n may also include further folding apparatus, label application units, packaging stations and the like.

The synchronizing and control unit 10' controls all the elements, apparatus units and printing stations as before, and the drive motors 41–44 therefor as well as a drive motor 69 for the adhesive application unit 21.

Figure 5:
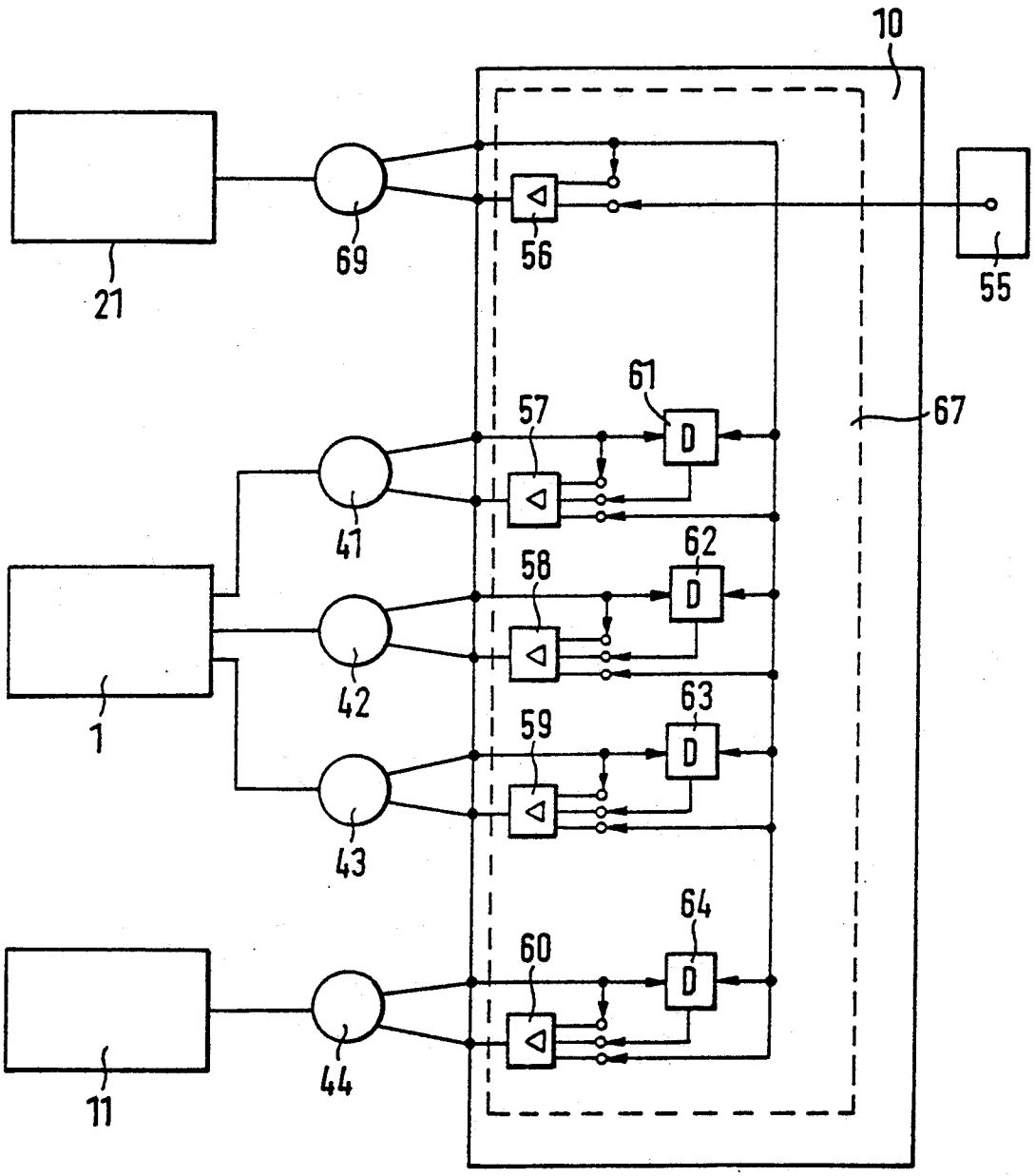
FIG. 5 is a control system for the machine system for the printing machine system of FIG. 4.

FIG. 5 is a block circuit diagram of one embodiment of the synchronizing and control unit 10'. It is, in general, similar to the unit illustrated in FIG. 2, and the same reference numerals have been used. FIG. 5 illustrates only those control units and microprocessors which are strictly necessary for the system illustrated in FIG. 4. Of course, if the overall printing machine installation as illustrated is expanded with further additional, individually driven auxiliary apparatus units, the overall control unit must be suitably expanded.

Speed control of the motors 41 to 44 is provided by a control circuit 67. The adhesive application unit 21 is driven by a motor 69, which is likewise controlled from the circuit 67. The control circuit 67 has an associated motor controller 56, 57, 58, 59, 60, one for each motor, as well as microprocessors 61–64. I/O unit 55 is provided to furnish a command signal for speed control of the motor 69, which, as the motor driving the last—in the direction of movement of the web 45—motor can then be used to control the speed of all the other motors as well. The controller 56 receives a feedback signal from the motor 69, representative of actual speed of the motor 69, and forms a control signal for the motor 69 to change it, as well known, in a servo control loop. The controllers 57–60 receive the command signal in form of the respective actual speed signal of the motor 69 and, as an additional control signal the actual speed signal of the respective motor. The actual speed of the motor 69 is, additionally, applied to the microprocessors 61–64 which, due to the algorithms contained therein and representative of the speed-load characteristics of the motors and the respective connected loads, provide additional control signals determined by the particular load-speed characteristics of the motors and the connected loads or, rather, of the characteristics of changes in load and speed.

The control circuit 67 matches the speeds of motors 41–44 to the actual speed of the motor 69, while considering the reaction to which the motors are subjected, looked at from the point of view of running or coursing of the paper path through the systems and, eventually, through the adhesive application unit 21 driven by motor 69.

Figure 6:
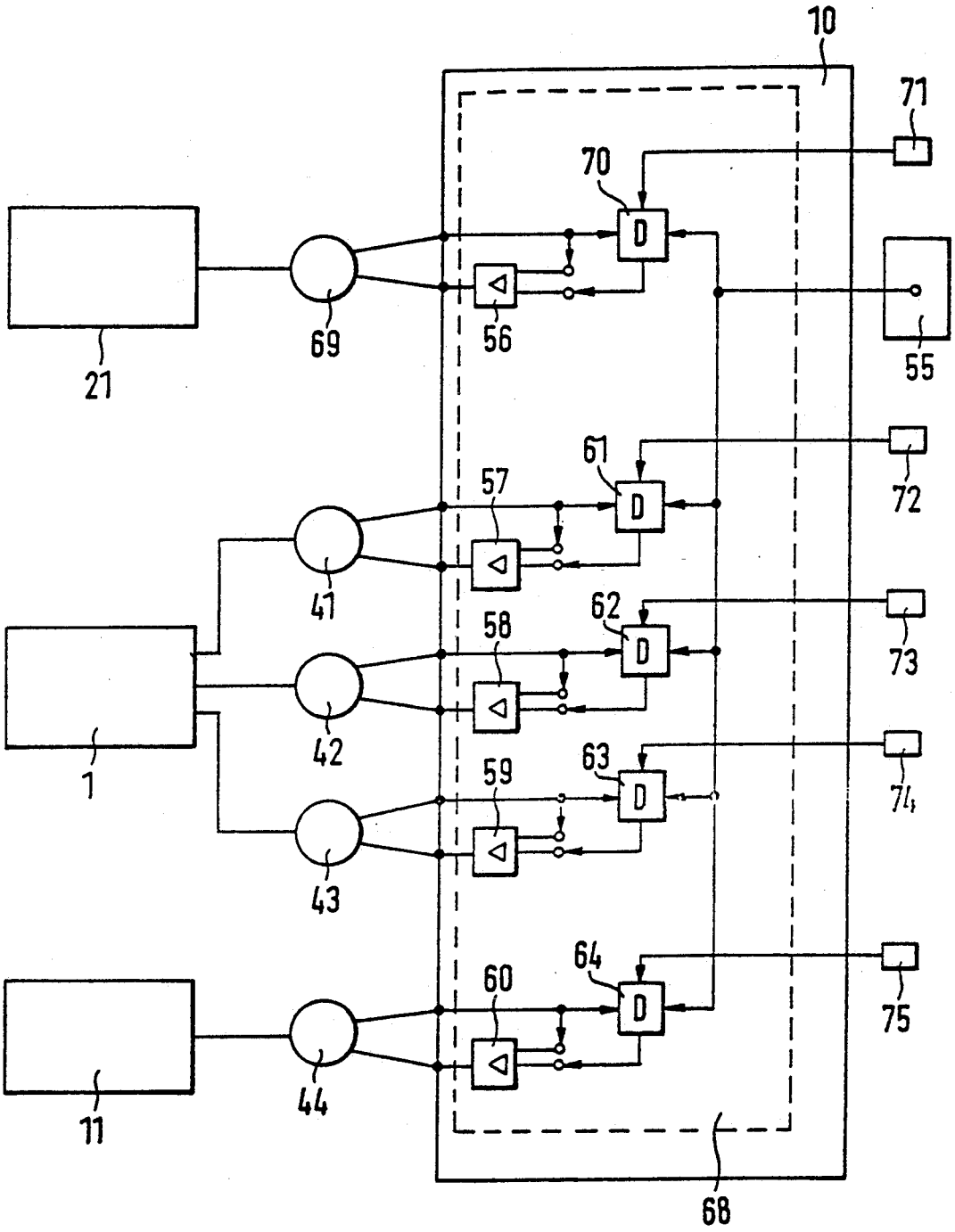
FIG. 6 is another embodiment of a control circuit for the machine system of FIG. 4, in block diagram form.

The system shown in FIG. 5 can be expanded, as shown in FIG. 6, which, generally, is similar to that shown in FIG. 5 with the difference, however, that the command signal derived from the I/O unit 55 is applied to all the microprocessors 61–64 and 70 as well. Further, sensors 71, 72, 73, 74, 75 are provided, located physically at specific locations along the paper path of the webs 45, 46, respectively, and providing signals to the respective microprocessors 70, 61, 62, 63, 64 as additional control signals.

Applying the command signal from I/O unit 55 to control all the motors 41–44 and 69 provides for basic control of the motors with the same command signals. Adding further signals derived from sensors 71–75, connected to the respective microprocessors, 70, 61, 62, 63, 64, to provide additional control signals further ensure response of the respective motors to control signals at an optimum rate. The control circuit 68, thus, is somewhat differently arranged from that of the control circuit 67 (FIG. 5). The control circuit 68 provides for control of the motors 41–44 and 69 in such a manner that all of the motors which are so driven and controlled have optimum synchronization and cooperation. The use of sensors 71–75, responding for example to markers applied to the respective webs 45, 46, further ensures that the motors 41–44 are not subjected to the possibility that their speeds begin to diverge although they have a common control or command signal. The circuit 68 has the further advantage with respect to that of circuit 67 (FIG. 5) that the motor speeds of motors 41–44 are immediately controlled by the same command signal as that of the speed of the motor 69, so that the speeds of the motors 41–44 are not based on the speed of the motor 69 which is under continuous servo control based on the command signal from I/O unit 55, which causes the motors 41–44 to follow variations of the speed of the motor which is already following the difference between its speed and that commanded by the signal from I/O unit 55.

Figure 7:
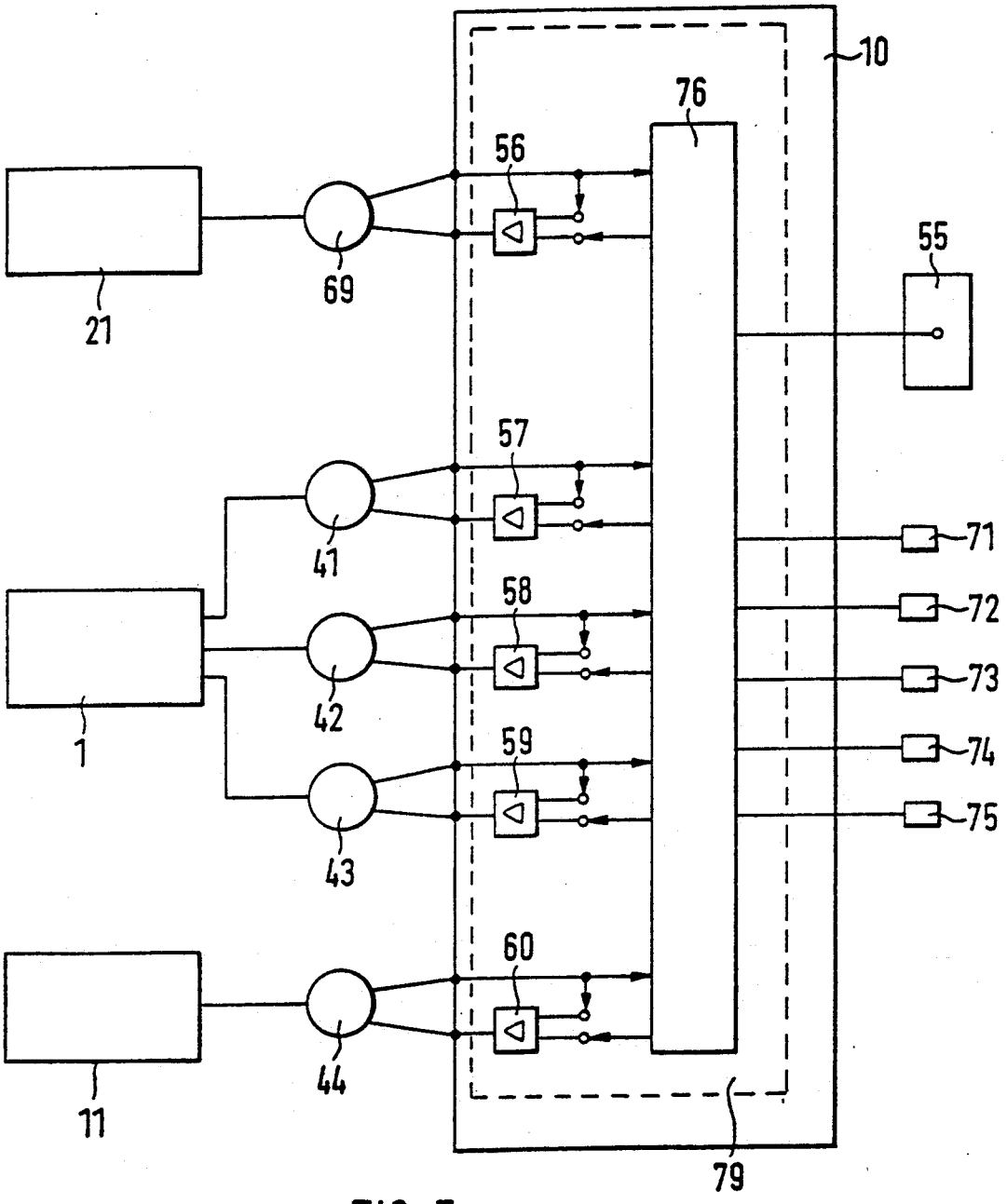
FIG. 7 is a block diagram of yet another control system for the printing machine system of FIG. 4.

The synchronizing and control unit 10' of FIG. 7 illustrates a control system 79 which, in addition to the control circuit 68 and 67 of FIGS. 6 and 5, respectively, has a microprocessor 76. The microprocessor 76 receives the actual speed signals from the motors 41–44 and 69 and processes the actual speed signals in accordance with a suitable algorithm, in which the input energy to load characteristics of the motors are considered, stored for example in a suitable memory. The microprocessor 76, thus, provides, directly, output control signals which interrelate the actual speed signals derived from the motors 41–44 and 69 and generates internal command signals for the controllers 56–60 The algorithm within the microprocessor 76 may contain fixed values representative of the motor energy—speed characteristics and memories, such as programmable memories which can be changed to enter therein characteristic parameters and measured values of the functionally interconnected stations, accessory units and auxiliary units, as well as data derived by the sensors 71–75. The sensors 71–75 are the same as those described in connection with FIG. 6.

The microprocessor 76 and controllers 56–60 all form part of the control circuit 79, FIG. 7. The microprocessor 76 has the same function as the microprocessors 61–64 and 70 of the circuit 69 of FIG. 6. Additionally, however, and as well known in motor control, the operating characteristics of the motors 41–44 and 69 can be considered and control signals derived which consider the respective motor characteristics and loads, so that, based on a servo control system, the speeds of the motors 41–44 and 69 can be controlled to react with shortest possible delay and, further, ensures that motors do not lose synchronism.

Microprocessor control systems for motors, or for a group of motors, by and themselves are well known and any suitable arrangement may be used. Control of multiple motors for multiple drive, dependent on individual motor and respectively connected load characteristics is also well known, for example from automatic multi-unit train control, in which individual drive motors for separate vehicle units operate in unison, although the individual loads on the respective units may vary, for example due to different passenger or freight loading.

The printing machine system in accordance with the present invention thus permits highly versatile application of existing units and structural elements, which are all expensive, and optimum utilization. Importantly, it permits ready functional and operational connection of different accessory and auxiliary units within printing machine subsystems to match the requirement of printing stations and specific accessory or auxiliary units with respect to any particular printing job, without investment in apparatus which may stand idle and may not be continuously used for printing jobs which are expected. Such apparatus, for example, are lacquering stations or units, adhesive stations, multiple folders and the like.

The printing machine system in accordance with the present invention, additionally, provides for excellent interconnection and mechanical control as well as electronic control of the respective subsystems and auxiliary and accessory units. Mechanical drive of printing stations from a common drive shaft is economically effective; it is supplemented by electronic control of other auxiliary or accessory units and, further, electronic control of the interrelation of the respective subsystems of the overall printing plant to permit versatile employment of available apparatus. Electronic control of the interrelationship of the respective printing machine subsystems has the particular advantage that the physical location of the respective subsystems and/or the auxiliary and accessory units need not be based on mechanical drives alone, but permit versatile positioning, as desired. Mechanical synchronization by mechanical drive shafts sometimes is not possible or desirable; there is a limit to the length of drive shafts along the printing machine subsystems, while still retaining synchronization. The printing machine system has the additional advantage of highly flexible configuration, without requiring expensive control systems, which would be the case if each and every single printing station and/or each and every single accessory or auxiliary apparatus were driven by its own drive torque. A combination, thus, of mechanical drive systems, with selective individual electronic control, particularly in one of the printing subsystems which has accessory or auxiliary units which are not used at all times, provides an overall printing plant installation which is economical and can be efficiently utilized.

Various changes and modifications may be made, and any features described herein may be used with any of the others, within the scope of the inventive concept. Of course, if the subsystem 11 has some, or all of the auxiliary apparatus units, such as the lacquering unit 6, and the units 21–24, the synchronization and control unit 10, 10' as well as the guide roller systems 47–50 and 53, 54, permit ready connection of the web 45 to the subsystem 11 in case of breakdown or malfunction of some or all of the printing or paper handling stations or units in the subsystem 1.

I claim:

1. Multi-station printing machine system having a first printing machine subsystem (1) for printing on a first web (45) comprising at least one first printing station (2, 3, 4, 5);

a first accessory apparatus (7, 8, 9) receiving the first substrate web (45) from said at least one first printing station;

a first electric machine drive motor means (41, 43) coupled to drive said at least one first printing station and said first accessory apparatus;

at least one further printing machine subsystem (11) for printing on at least one further substrate web (46) comprising at least one further printing station (12, 13, 14, 15);

a further accessory apparatus (16, 17, 18, 19); and a further electric machine drive motor means (44) coupled to drive said at least one further printing station and said further accessory apparatus; and driven auxiliary apparatus (6; 21–24) physically positioned adjacent to and associated with said first printing machine subsystem (1), and comprising, in accordance with the invention, first controllable drive motor means (42, 69) coupled to said auxiliary apparatus (6; 21–24);

electrical synchronization and control means (10, 10') coupled to the controllable drive motor means (42, 69) for said auxiliary apparatus (6; 21–24) for synchronizing the operation of said controllable drive motor means with the operation of at least one of said electric machine drive motor means (41, 43; 44) of the respective machine printing system (1; 11); and substrate web guiding means (47, 48, 49, 50; 53, 54) on said first and on said at least one further machine printing subsystem (1, 11) for guiding the at least one further substrate web (46) from said at least one further machine printing subsystem to said auxiliary apparatus (6; 21–24) and between said first and at least one further subsystems.

2. The system of claim 1, wherein said auxiliary apparatus (6; 21-24) is uniquely present in said first printing machine subsystem and said at least one further printing machine subsystem is devoid of said auxiliary apparatus.

3. The system of claim 1, wherein the first auxiliary apparatus comprises at least one of a lacquering station or unit (6);

a perforating station or unit (20);

an adhesive application station or unit (21);

a product positioning station or unit (22);

a product transport station or unit (23); and a product handling station or unit (24).

4. The system of claim 3, wherein said auxiliary apparatus (6; 21-24) is uniquely present in said first printing machine subsystem and said at least one further printing machine subsystem is devoid of said auxiliary apparatus.

5. The system of claim 1, further including coupling means (27-30; 31, 32) selectively connecting said first electric machine drive motor means (41) and said at least one first printing station;

further coupling means (34-40) selectively connecting said further electric machine drive motor means (44) and said at least one further printing station; and means (42, 69) for driving said auxiliary apparatus (6; 21-24) independently of said first electric machine drive motor means (41, 43, 44) and forming said controllable drive motor means.

6. The system of claim 5, wherein at least one of said printing machine subsystems further include cooling units or stations (8, 17) and folding units or stations (9; 18, 19); and wherein at least one of the coupling means includes selectively engageable clutch means (27-32; 34-40), individually, separately and independently selectively coupling at least one printing station of the respective subsystem, the respective cooling unit or station (8) and the respective folding unit or station (9), to a first synchronized machine drive including said first machine drive motor means (41).

7. The system of claim 1, wherein said first electric machine drive motor means comprises a first drive motor (41) and a first drive shaft (25) located longitudinally along said at least one printing station (2-5) of the first printing machine subsystem (1);

a second drive motor (43) and a second drive shaft (26) coupled thereto, and driving said first accessory apparatus (8, 9) forming part of the first printing machine subsystem (1);

and coupling means (27-30; 31, 32) coupled to the respective drive shafts and interconnecting the respective drive shafts with, respectively, said at least one printing stations and said accessory apparatus; and a third drive motor (42; 69) coupled to at least one (6, 21) of said auxiliary apparatus.

8. The system of claim 1, wherein said substrate web guiding means (47-50) include guide means (47-50) located to guide said further substrate web (46) to said auxiliary apparatus in a path which is at least in part identical to the path of said first substrate web through said auxiliary apparatus.

9. The system of claim 1, further including a plurality of machine operation sensors (71-75) coupled to at least the first of said printing machine subsystems (1) and sensing operation of the machine, the accessory apparatus thereof, and said auxiliary apparatus, and providing output signals representative of machine operation and passage of the respective web through the respective machine subsystem, said sensing means providing output signals which are coupled to said synchronizing and control unit (10, 10').

10. The system of claim 1, further including register mark sensing means (77) coupled to at least one of said printing machine subsystems, and sensing register marks on the respective substrate web passing through the respective printing machine subsystem; and computing and control means (78) coupled to receive signals from said register mark sensing means and providing modifying signals to the synchronizing and control means (10, 10') for additionally controlling operation of at least one of the drive motor means.

11. The system of claim 1, wherein the synchronizing and control means (10, 10') is coupled to said first electric machine drive motor means (41, 43), to said further electric machine drive motor means (44) and to the controllable drive means (42, 69) coupled to said auxiliary apparatus (6; 21-24) for driving said auxiliary apparatus; and wherein said synchronizing and control means (10, 10') independently, selectively, separately controls drive of all said drive motor means.

12. The system of claim 11, wherein (FIG. 7) said first subsystem has a first subsystem motor drive means (41, 43); and the synchronization and control means (10') comprises a microprocessor multiple motor control circuit (79) for controlling said first subsystem motor drive means, said auxiliary apparatus controllable drive motor means (42, 69) and said further machine drive motor means (44), said microprocessor controller (79) being connected to receive a command signal from said input/output unit (55), said microprocessor controller further receiving actual speed feedback signals from the respective motor drive means, and processing said feedback signals in a servo speed control loop, said microprocessor providing output control signals for controlling the speed of operation of the respective motor drive means in synchronized operation based on said feedback signals and based on stored characteristics representative of operating characteristics of the respective drive motor means to modify the signals applied to the respective motor drive means in accordance with the individual respective characteristics.

13. The system of claim 12, further including a plurality of sensors (71-75) sensing operating conditions of said subsystems and providing operating condition control signals to said microprocessor controller for further modifying the control signals for the respective motor drive means.

14. The system of claim 11, wherein (FIGS. 2, 3) said first subsystem (1) includes a first subsystem motor drive means (41, 43); and wherein the synchronizing and control means (10) comprises a first motor control circuit (66) controlling the speed of operation of said first subsystem motor drive means (41, 43) and coupled to receive input command signals from said input/output unit (55); and a second motor control circuit (65) including a further printing machine motor controller (56) and an auxiliary apparatus motor controller (57) for controlling, respectively, said further printing machine drive motor means (44) and said auxiliary apparatus drive motor means (42), at least one of said machine motor controller and auxiliary apparatus motor controller being coupled to receive a command signal from said input/output unit (55) for controlling the speed of the respective motor, said motor controllers further receiving feedback signals from the respectively controlled motor means (44, 42) in a closed servo loop; and a microprocessor (61) providing modifying control signals representative of operating characteristics of the auxiliary apparatus drive motor means (42) to the auxiliary apparatus controller (57).

15. The system of claim 14, wherein said first motor drive means (41, 43) comprises a first machine drive motor (41) and a second machine drive motor; and said first motor control circuit (66) includes a first (58) and a second (59) controller coupled, respectively, to said first and second machine drive motors (41, 43), at least one of said motor controllers receiving input command signals from said input/output unit (55) and feedback signals from the respectively controller drive motor (41, 43) in a closed servo loop; and second microprocessor means (62) coupled to one of said motor controllers for providing modifying control signals representative of operating characteristics of the associated drive motor to the associated controller (59).

16. The system of claim 14, further including register mark sensing means (77) coupled to at least one of said printing machine subsystems, and sensing register marks on the respective substrate web passing through the respective printing machine subsystem; and computing and control means (78) coupled to receive signals from said register mark sensing means and providing modifying signals to the auxiliary apparatus motor controller (57) controlling operation of the auxiliary apparatus (6) drive motor means (42).

17. The system of claim 11, wherein said auxiliary apparatus (6; 21-24) is uniquely present in said first printing machine subsystem and said at least one further printing machine subsystem is devoid of said auxiliary apparatus.

18. The system of claim 11, further including an input/output (I/O) unit (55) coupled to said synchronizing and control means (10, 10') for entering command signals thereinto.

19. The system of claim 11, wherein (FIG. 5) said first subsystem has a first subsystem motor drive means (41, 43); and the synchronizing and control means (10') comprises a third motor control circuit (67) having a third motor controller (56) to control the auxiliary apparatus drive motor means (69) and coupled to said auxiliary apparatus (21) physically associated with said first subsystem;

a plurality of additional controllers (57, 58, 59), respectively connected to control said first subsystem motor drive means (41, 43) and said further printing machine motor drive means (44);

a plurality of microprocessors (61-64) connected to and controlling said respective additional controllers (57-60);

said third motor controller (56) being connected to receive a command signal from said input/output unit (55), said third motor controller (56) being connected to said auxiliary apparatus drive motor means (69) in a closed feedback servo loop, said closed feedback servo loop providing a speed control signal, which speed control signal is coupled to said plurality of microprocessors, and further connected to said plurality of additional controllers, said microprocessor providing modifying control signals representative of operating characteristics of the respective drive motor means.

20. The system of claim 11, wherein (FIG. 6) said first subsystem has a first subsystem motor drive means (41, 43)

and the synchronization and control means (10') comprises a third motor control circuit (68) having a third motor controller (56) to control the auxiliary apparatus drive motor means (69) and coupled to said auxiliary apparatus (21) physically associated with said first subsystem;

a plurality of additional controllers (57, 58, 59) respectively connected to control said first subsystem motor drive means (41, 43) and said further printing machine motor drive means (44);

a plurality of microprocessors (61-64) connected to and controlling said respective additional controllers (57-60);

said third motor controller (56) being connected to said auxiliary apparatus drive motor means (69) in a closed feedback servo loop, said closed feedback servo loop providing a speed control signal;

said plurality of additional controllers (57, 58, 59), being connected to the associated motor drive means (41, 43) and said further printing machine motor drive means (44) in a closed feedback servo loop providing a speed control signal;

the speed control signals connected to said respective motor controllers (56; 57, 58, 59) being further connected to the associated microprocessor (70, 61, 62, 63, 64);

said third motor controller (56) and said plurality of additional controllers (57, 58, 59) being further coupled to receive a command signal from said input/output unit (55); and operating sensing means (71-75), providing machine operating sensing signals, said respective machine operating signals from the respective sensing means (71-75) being connected to the respective microprocessors (70, 61-64), said microprocessors providing modifying control signals representative of operating characteristics of the respective drive motor means and of the operation of the respective subsystem with which said sensing means are associated.

* * * * *